US005614772A

United States Patent [19]

Bütow et al.

[11] Patent Number: 5,614,772

[45] Date of Patent: Mar. 25, 1997

[54] OPERATING DEVICE FOR AN ELECTRONIC SWITCHING DEVICE WITH A CHANGEABLE FRONT FOIL

[75] Inventors: Klaus Bütow; Harald Schilling, both of Freiburg, Germany

[73] Assignee: Bregenhorn, Bütow & Co., Elektrotechnische Geräte GmbH, Freiburg, Germany

[21] Appl. No.: 428,390

[22] Filed: Apr. 25, 1995

[30] Foreign Application Priority Data

Apr. 25, 1994 [DE] Germany ..... 44 14 412.1

[51] Int. Cl.[6] ..... H01H 35/00

[52] U.S. Cl. ..... 307/119; 200/5 R; 307/112; 307/40; 307/47

[58] Field of Search ..... 200/5, 5 R, 5 A; 307/112, 140, 47

[56] References Cited

U.S. PATENT DOCUMENTS 4,022,993 5/1977 Shattuck ..... 200/5 A
4,647,728 3/1987 Retallack et al. ..... 200/5 R
5,341,029 8/1994 Johnson ..... 307/112

FOREIGN PATENT DOCUMENTS 3838747 3/1990 Germany .
4013321 11/1991 Germany .
9110705 2/1992 Germany .

*Primary Examiner*—William M. Shoop, Jr.
*Assistant Examiner*—Kim Lockett
*Attorney, Agent, or Firm*—Cohen, Pontani, Lieberman, Pavane

[57] ABSTRACT

An operating device for electronic switching devices, which operating device includes a front plate, one or more actuators applied to the from plate for the purpose of actuating one or more modules, a changeable from foil which can be applied to the front plate and which is designed to hold a coding, a recognition system which reads in the data of the coding, and an intelligent control device which picks up the read-in data from the recognition system and assigns, in dependence on the read-in data, a user-specific activation function to each actuator.

9 Claims, 3 Drawing Sheets

OPERATING DEVICE FOR AN ELECTRONIC SWITCHING DEVICE WITH A CHANGEABLE FRONT FOIL

BACKGROUND OF THE INVENTION

1. Field of the Invention

The present invention relates to an operating device for electronic switching devices with a changeable front foil.

2. Description of the Prior Art

It is known that operating devices are often needed in apparatus and machine construction which in and of themselves always contain the same actuators and the same modules to be actuated. Usually, the actuators consist of several switches, in particular, signal switches or intermediate switches, or of various keys, e.g., signal keys. The modules, which include power relays, magnetic valves, pumps, motors and the like, are actuated by the individual switches and keys and carry out a preassigned function.

Usually, the actuators are permanently mounted on a front plate of a machine housing, which makes any user-specific arrangement or rearrangement of the actuators impossible or very expensive. The latter is especially disadvantageous, because in the modern workplace the actuators must be arranged in accordance with the principles of ergonomics and occupational medicine, so that the user may select the configuration best and most individualized for him. User-specific arrangements also permit quicker reaction and user-friendly operation.

Furthermore, the known operating electronics do not permit the individual components to be arranged in a manner which corresponds to the particular physical arrangement of the modules. Because of the lack of flexibility in conventional operating devices and the permanent positioning of the actuators on the front plate, it is not possible for the placement of the machines or devices to be reflected on the front plate. If a module is moved, it is not possible, with conventional operating devices, for the user to adapt the configuration of the components on the front plate to the new requirements.

An interchangeable decorative foil is known from DE 10 13 321 A1 that can be applied to the base plate of a display operating device. The decorative foil is provided with partially transparent areas in order to make visible the display and operating components mounted in the base plate.

A switching device for a hi-fi and/or stereo system is known from DE 91 10 705.9 01 which uses a liquid crystal display to convey information about selected devices of the system. The known system also has an operating device which permits user-specific functions to be entered by means of operating keys or operating sensors.

German reference DE 38 38 747 A1 describes a security key device with a membrane keyboard which permits the activation of two adjacent keys.

SUMMARY OF THE INVENTION

The object of the present invention is to provide, while avoiding the aforementioned disadvantages, an operating device with actuators that can be arranged to meet the requirements of a particular user while simultaneously maintaining the underlying functional characteristics of the actuators.

A further object of the invention is to provide an operating device for electronic switching devices which is designed so that each individual actuator activates various modules in a user-specific manner and can thus carry out various actuation functions.

Within this flamework it is an additional object of the invention to provide a programmable interface between the individual actuators and the activatable modules, whereby the interface is programmable in a user-specific manner. Preferably, the interface consists of an intelligent control electronics device.

Another object of the invention is to provide a changeable front foil which can be easily applied to the operating device, is labelled according to the function of each actuator, and transmits this function to the intelligent control electronics device.

These objectives and others clearly inferable from the following description are attained by the inventive operating device for electronic switching devices which has a device changeable front foil. The changeable front foil is applied to a front plate of the operating device above one or more actuators applied to the front plate for the purpose of actuating modules. The front foil accommodates a code which is read by a recognition system contained in the operating device. An intelligent control device picks up the read-in code data from the recognition system and assigns a user-specific actuation function to each actuator based upon the read-in code data.

Pursuant to another embodiment of the invention the recognition system includes an optical code reader made up of a transmitting device and a receiving device. The optical code reader can be formed of a plurality of light barriers adjacent to one another so that the light barriers are lined with a coating strip applied to the changeable front foil.

In still a further embodiment of the invention the intelligent control device includes a microprocessor which stores the desired switching programs and activates the desired program in dependence upon the read-in code.

Still a further embodiment of the invention has a front board attached to the front plate, which front board is designed to accommodate the actuators, the recognition system and the control device. The front plate has openings aligned with the actuators so as to permit the actuators to be actuated via the changeable front foil.

The front plate is preferably made of a magnetically conductive material and the changeable front foil has a magnetic foil with an adhered-on decorative foil whereby the magnetic foil adheres to the magnetically conductive material of the front plate.

In another embodiment of the invention the changeable front foil is impermeable to light and has transparent or cut-out areas which correspond to the actuators.

In still a further embodiment of the invention the changeable front foil is labeled in a user-specific fashion in the area of the transparent locations.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
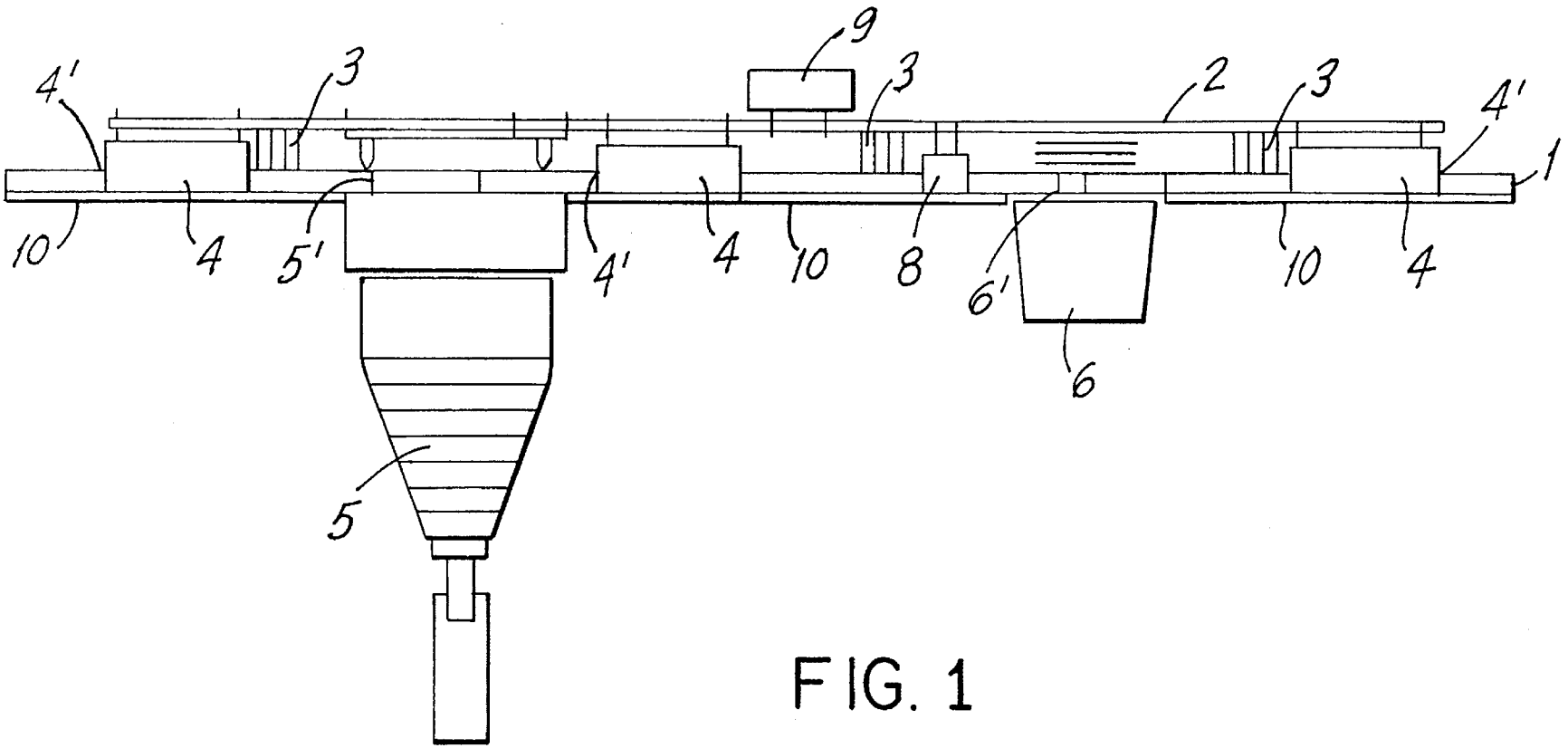
FIG. 1 is a cross-section through a from plate of the operating device for electronic switching devices with a changeable from foil according to the invention.

FIG. 1 shows a from plate identified by the reference number 1. The from plate 1, which is preferably made of steel, is attached in a known manner to a device or machine (not shown). On the side of the front plate 1 facing the machine, a from board 2 is mounted at a certain distance from the front plate 1. For the purpose of mounting, conventional attachment means are used. It should be noted that it is imperative for the outward surface of the front plate 1 to be as flat as possible. It is therefore helpful to use, for example, flat head screws on the outward side, facing the user, of the front plate 1 in order to mount the front plate 1 to the front board 2. Depressions 7 are provided on this outward side that correspond to the screws. Spacing bolts 3 or similar spacing means can be used to distance the front board 2 from the fixed plate 1.

In a manner that is illustrative but not limiting, FIG. 1 schematically depicts several actuators, consisting of the push buttons 4, an intermediate switch 5 and a regulating resistor 6. The actuators are preferably equipped with background lighting that is turned on when the elements are actuated. All the actuators are arranged on the front board 2 on the side facing the user. An optical code reader 8 is also attached to this user-accessible side. In the front plate 1, there are recesses 4', 5' and 6' corresponding to the actuators 4, 5, 6, and to the optical code reader 8.

The push buttons 4 and the reflex coupler 8 are designed so as to be essentially flush with the forward edge of the from plate 1. This can be accomplished either by the selection of suitable spacing bolts or by the selection of suitable actuators. The regulating resistor 6 and the intermediate switch 5 project through the recesses 6' and 5', respectively.

A programmable control electronics device 9, which is described in detail below, is also attached to the front board 2. A changeable front foil 10, also described in detail below, is located on the front plate 1, facing the user. The optical code reader 8, as well as the actuators, are electrically connected to the control electronics device 9 via conductor paths (not shown) of the front board 2. Additional electrical connections run from the control electronics device 9 to the modules to be actuated.

Figure 2:
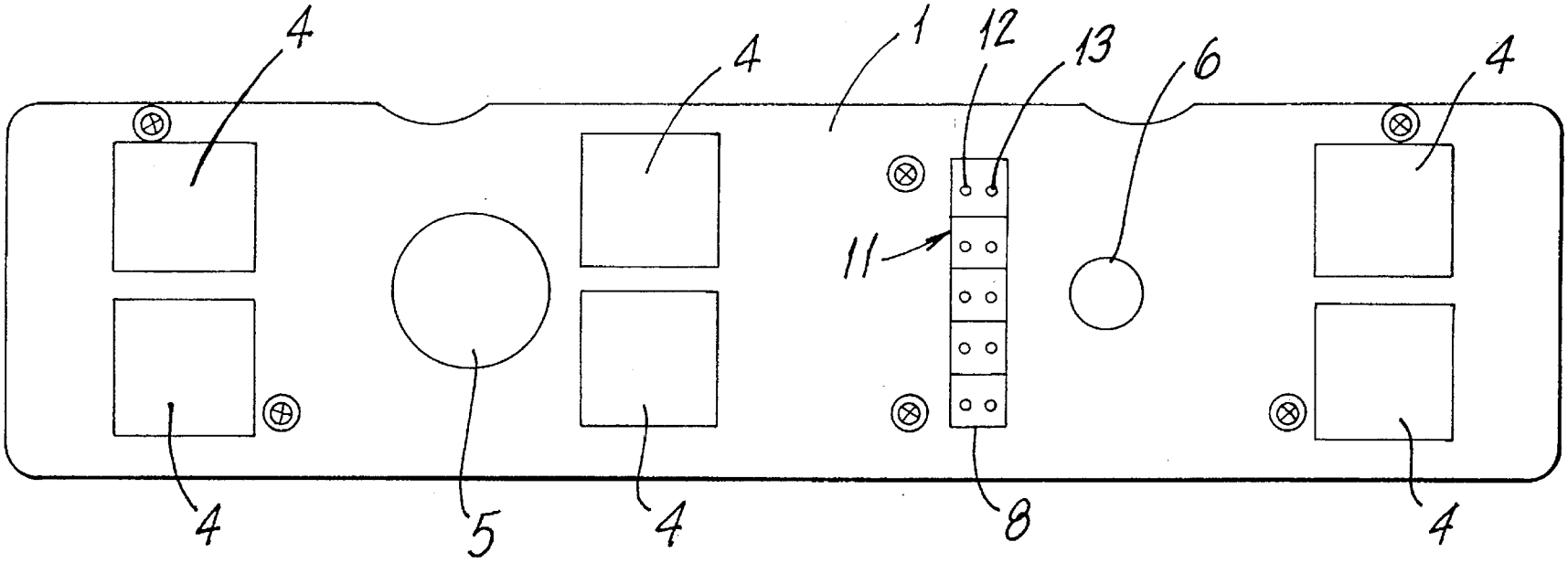
FIG. 2 is a from view of the front plate in FIG. 1.

FIG. 2 shows a front view of the front plate 1, whereby the actuators are identified by the same reference numbers used in FIG. 1. The optical code reader 8 has a transmitting device and a receiving device, which advantageously consist of one or more reflection light barriers 11, which can be operated with either direct or alternating light. Each individual reflection light barrier 11 has a light source 12, consisting, for example, of a GaAs- diode, as well as a receiver 13, consisting for example, of an Si photo diode. In the example in FIG. 2, a 5-bit optical recognition system is used, which offers 32 coding possibilities, whereby the individual light barriers 11 are arranged adjacent to one another. For security reasons, there are 2 impermissible codes, namely "0" (binary 00000) and "31"(binary 11111). This is necessary in order to avoid malfunctions of the optical coder reader 8, because the latter, when the changeable front foil 10 is not in place, will evaluate the total darkness as the code "0". Analogously, if the reflex coupler is brightly lit, the code "31" is triggered. The length of the code is given here as 5 bits only by way of example and may be varied depending on the requirements and complexity of the devices.

Figure 3:
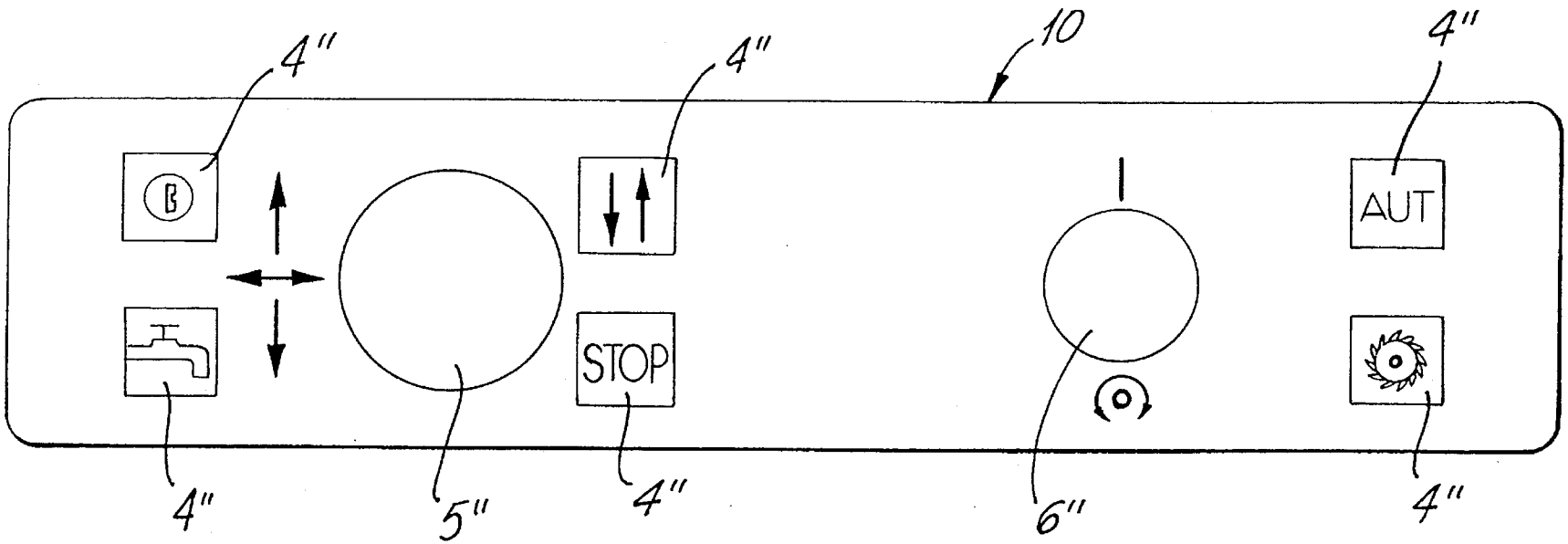
FIG. 3 is a from view of a changeable from foil according to the invention which can be applied to the front plate in FIG. 1.

FIG. 3 shows a front view of the changeable front foil 10 that can be applied to the front plate 1. The attachment of the changeable front foil 10 to the front plate 1 may be carried out in various ways, for example, by means of slide slot, contact adhesive, electrostatic attraction or vacuum. In the preferred form, a changeable front foil 10 consisting of a magnetic foil with a stuck-on decorative foil is used, which adheres to the magnetically conductive material of the front plate 1. The generally light-impermeable changeable front foil 10 has transparent or cutout areas that correspond to the actuators. FIG. 3 shows several transparent areas 4' corresponding to the push buttons 4 shown in FIG. 2. As needed, these transparent areas 4' may be provided with symbols or other indicators or labels, the arrangement of which may be determined by the user. The areas 4' consist of an elastic material which permits the activation of the push buttons 4, whereby the flexibility of the former is adjusted to the key lift of the individual buttons. In the area of the actuators that are set off from the front plate 1, such as, for example, the intermediate switch 5 and the regulating resistor 6, there are corresponding openings 5' and 6' in the changeable from foil 10. The changeable front foil 10 is aligned with the front plate 1 in such a way that the transparent and cut-out areas correspond precisely to the actuators.

On the reverse side of the changeable front foil 10, coding strips (not shown) are provided, which are arranged so that they lie across the reflected light barriers 11 of the optical code reader 8. Each coding of the coding strips corresponds to a specific arrangement and assignment of the actuators. The front side of the front foil 10, which faces the user, is impermeable to light.

The control electronics device 9 forms an interface between the actuators and the modules. Each actuator is connected to the control electronics device 9 via lines in the front board 2. Electrical lines (not shown) run from the control electronics device to the respective modules. The optical code reader 8 is also electrically connected to the control electronics device 9 for the purpose of transmitting the recognized coding. The manner in which these electrical connections are made is well within the understanding of those skilled in the an and thus will not be described here.

The control electronics device 9 has, as its basic element, a microprocessor of a known type, which simultaneously contains all desired switching programs and, depending on the particular recognized coding, actuates a desired program. The switching programs in question can be transmitted by a programming device to a programmable component located in the processor. The programmable components which may be used include, among others, PROMs, EPROMs and EEPROMs.

The arrangement according to the invention functions as follows: When the changeable from foil 10 is placed upon the side of the from plate 1 facing the user, the coding of the coding strips is read in by the optical code reader 8. For this to happen, the coding strips must rest precisely upon the individual light barriers 11 of the optical code reader 8. To this end, alignment means may be provided. The codings that have been read in are transmitted to the control electronics device 9 and activate a corresponding switching program. Based on the switching program selected, a corresponding module is then activated upon actuation of an actuator. Thus the control device 9 functions as an electronic selective coupler which makes it possible to create a particular electrical path from an actuator to a module in a flexible manner, depending on the particular switching program begin run, and to address various modules with the same actuator, depending on the particular switching program.

The invention may be modified in many respects without overstepping its framework. Thus, for example, the number and types of actuators may vary from those shown in the drawings. Also, the embodiment of the changeable front foil may be adapted accordingly.

Furthermore, according to further design forms of the invention which, in respect to their basic idea, follow the design forms described above, other non-contacting recognition systems may be used as required instead of the optical code reader 8 described above by way of example. Furthermore, recognition systems that are not non-contacting are also possible. Moreover, as already noted, the length of the coding and the length of the recognition systems can be altered as needed. The position of the coding strips and of the optical code reader may be changed based on various technical requirements.

All structural parts may be replaced by other technically equivalent parts and the materials, dimensions and forms used may be selected anew as desired.

The invention is not limited by the embodiments described above which are presented as examples only but can be modified in various ways within the scope of protection defined by the appended patent claims.

I claim:

1. An operating device for an electronic switching device including at least one module, comprising:

a front plate;

at least one actuator mounted to the front plate for actuating the at least one module;

a changeable front foil removably mounted to the front plate so as to cover the at least one actuator, the changeable front foil accommodating a coding containing data;

recognition means for reading in the data of the coding; and an intelligent control means for picking up the read-in data from the recognition means and assigning, in dependence on the read-in data, a user-specific actuation function to the at least one actuator.

2. An operating device as defined in claim 1, wherein the recognition means includes an optical code reader which has a transmitting device and a receiving device.

3. An operating device as defined in claim 2, wherein the optical code reader is formed of a plurality of reflection light barriers arranged adjacent to one another at the front plate, the reflection light barriers being aligned with a coding strip applied to the changeable front foil.

4. An operating device as defined in claim 1, wherein the intelligent control means includes a microprocessor which contains desired switching programs and is operative to activate a desired program in dependence on the read-in coding data.

5. An operating device as defined in claim 1, and further comprising a front board attached to the front plate, the front board being adapted to accommodate the at least one actuator, the recognition means and the intelligent control means, the front plate having openings aligned with the at least one actuator so as to permit the at least one actuator to be actuated through the changeable front foil.

6. An operating device as defined in claim 1, wherein the front plate is made of a magnetically conductive material, the changeable front foil having a magnetic foil with an adhered-on decorative foil, whereby the magnetic foil of the changeable front foil adheres to the magnetically conductive material of the front plate.

7. An operating device defined in claim 1, wherein the changeable front foil is impermeable to light and has areas that are transparent and correspond to the at least one actuator.

8. An operating device as defined in claim 1, and further comprising labels arranged on the changeable front foil at the transparent areas.

9. An operating device as defined in claim 1, wherein the chargeable front foil is impermeable to light and has cut-outs that correspond to the at least one actuator.

* * * * *